US008261413B2

(12) United States Patent
Su

(10) Patent No.: US 8,261,413 B2
(45) Date of Patent: Sep. 11, 2012

(54) HINGE ASSEMBLY

(75) Inventor: Xiao-Guang Su, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 414 days.

(21) Appl. No.: 12/646,857

(22) Filed: Dec. 23, 2009

(65) Prior Publication Data

US 2011/0010893 A1 Jan. 20, 2011

(30) Foreign Application Priority Data

Jul. 15, 2009 (CN) ..... 2009 1 0304384

(51) Int. Cl.
*E05D 5/10* (2006.01)

(52) U.S. Cl. ..... 16/386; 16/320; 16/DIG. 14

(58) Field of Classification Search ..... 16/386, 16/320, DIG. 14; 403/DIG. 1
See application file for complete search history.

(56) References Cited

U.S. PATENT DOCUMENTS 2,615,738 A * 10/1952 Johnson ..... 403/161
3,264,678 A * 8/1966 Parmelee ..... 16/228
3,287,760 A * 11/1966 Moore ..... 16/265
4,847,950 A * 7/1989 Coleman ..... 16/363
4,874,118 A * 10/1989 Parlante ..... 16/386
5,735,021 A * 4/1998 Briggs ..... 16/369
6,553,626 B2 * 4/2003 Coburn ..... 16/386
6,630,878 B2 * 10/2003 Pan et al. ..... 379/433.13
6,701,809 B2 * 3/2004 Huang ..... 81/125
6,832,100 B2 * 12/2004 Hsieh ..... 455/550.1
7,794,080 B2 * 9/2010 Zelazowski ..... 16/228
8,087,844 B2 * 1/2012 Turner ..... 403/165
2003/0056332 A1 * 3/2003 Coburn ..... 16/386
2003/0154571 A1 * 8/2003 Hsiang et al. ..... 16/320
2003/0179880 A1 * 9/2003 Pan et al. ..... 379/433.13
2007/0090706 A1 * 4/2007 Davis et al. ..... 310/90.5
2007/0157432 A1 * 7/2007 Weinstein ..... 16/320
2010/0058557 A1 * 3/2010 Wang ..... 16/320

* cited by examiner

*Primary Examiner* — Jeffrey O Brien
(74) *Attorney, Agent, or Firm* — Altis Law Group, Inc.

(57) ABSTRACT

A hinge assembly includes a first connecting member, a second connecting member, a first fixing member, and a second fixing member. The first fixing member can extend through the first connecting member and the second connecting member. The first fixing member includes a first magnet. The second fixing member can extend through the second connecting member and be received in the first connecting member. The second fixing member includes a second magnet. The first fixing member is engaged with the second fixing member under the magnet force between the first magnet and the second magnet.

6 Claims, 4 Drawing Sheets

HINGE ASSEMBLY

BACKGROUND

1. Technical Field

The present disclosure relates to hinge assemblies.

2. Description of Related Art

A conventional hinge assembly usually includes a first connecting member and a second connecting member. The engagement between the first connecting member and the second connecting member is usually a threaded engagement. In assembling such hinge assembly, it is often not an easy task to cause the first connecting member to be engaged with the second connecting member via the threaded engagement.

BRIEF DESCRIPTION OF THE DRAWINGS

The components of the drawings are not necessarily drawn to scale, the emphasis instead being placed upon clearly illustrating the principles of a hinge assembly. Moreover, in the drawings, like reference numerals designate corresponding parts throughout several views.

DETAILED DESCRIPTION

Figure 1:
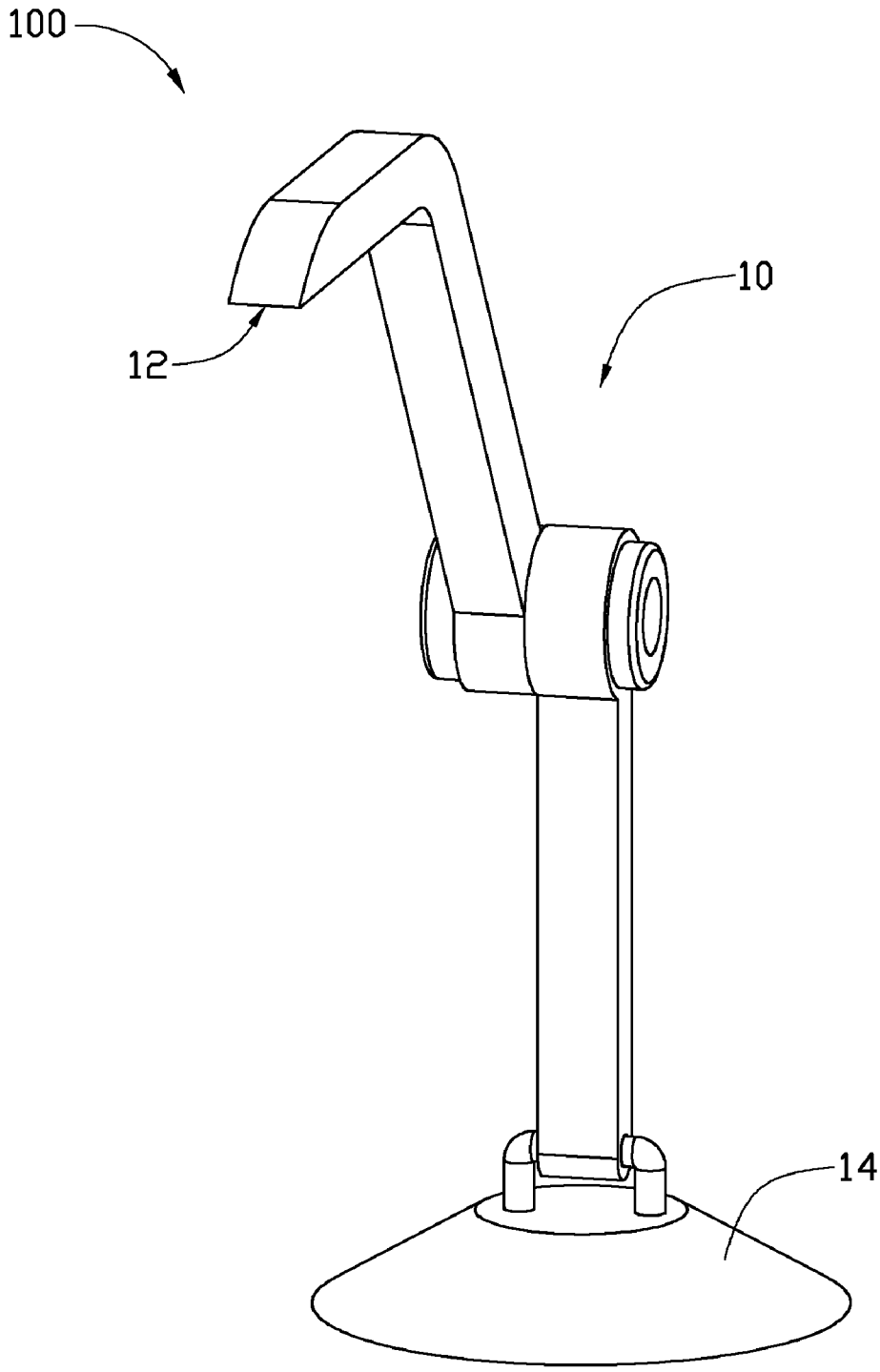
FIG. 1 is an isometric view of an electronic device with the hinge assembly in accordance with an exemplary embodiment.

Referring to FIG. 1, an electronic device 100 with a hinge assembly 10 is illustrated. The electronic device 100 can be a notebook computer, or a desk lamp, etc. In the embodiment, the electronic device 100 is a desk lamp. The electronic device 100 includes the hinge assembly 10, a lamp 12, and a stand 14. The hinge assembly 10 is configured for connecting the lamp 12 to the stand 14.

Figure 2:
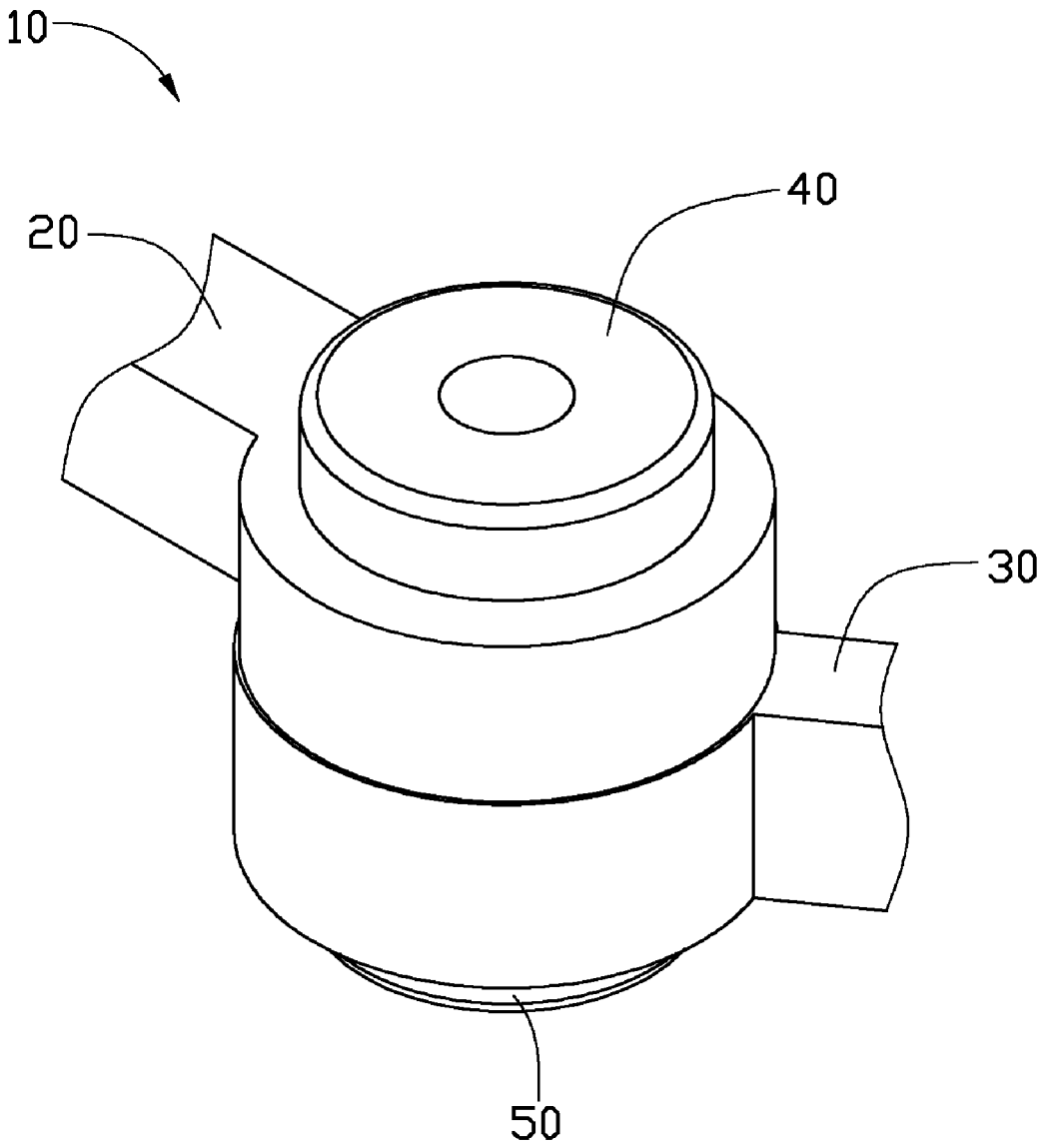
FIG. 2 is an isometric view of a hinge assembly of FIG. 1.
Figure 3:
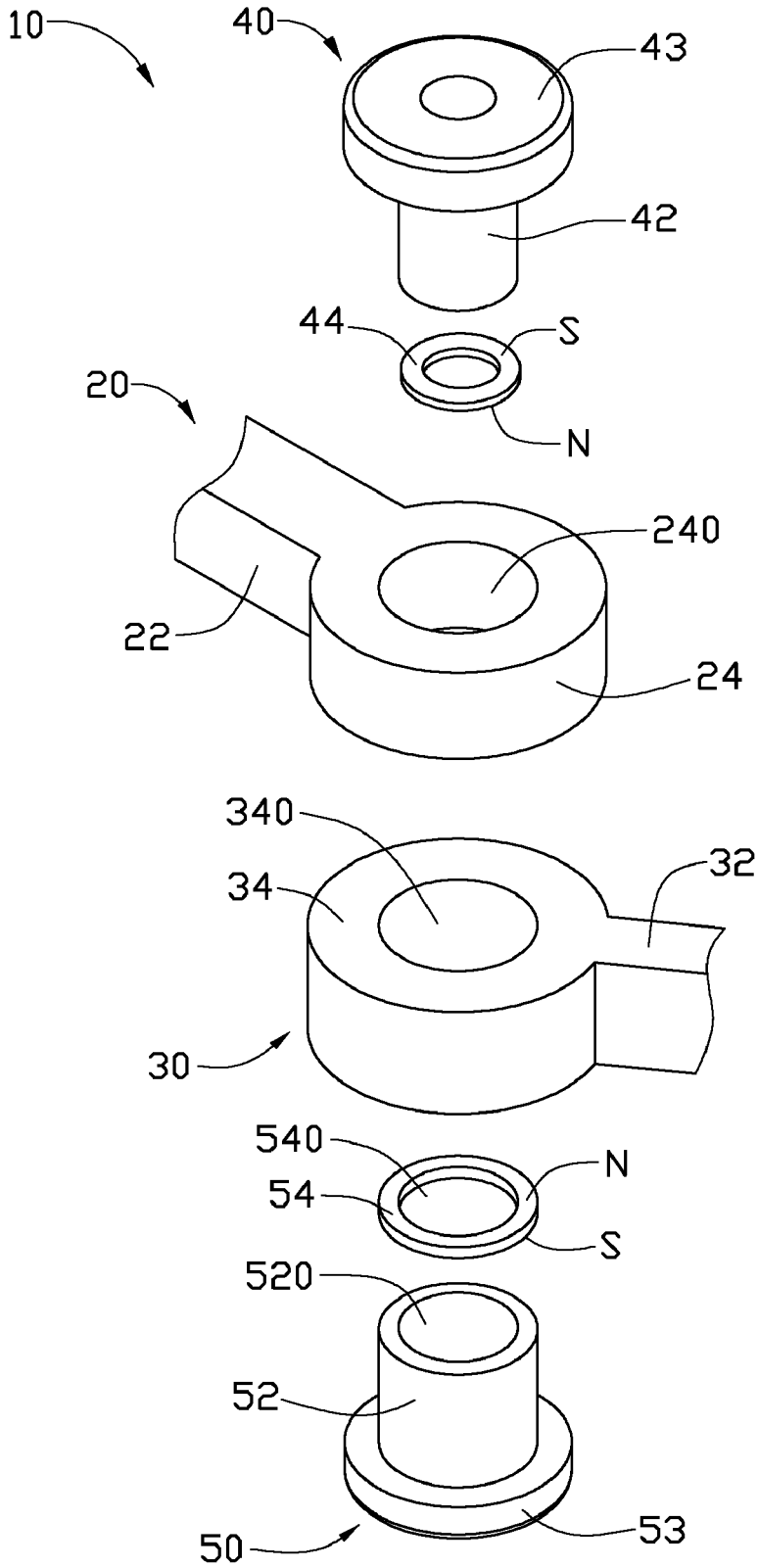
FIG. 3 is an exploded, perspective view of the hinge assembly of FIG. 2.

Referring also to FIGS. 2-3, the hinge assembly 10 includes a first connecting member 20, a second connecting member 30, a first fixing member 40, and a second fixing member 50.

The first connecting member 20 includes a first connecting portion 22 and a first fixing portion 24. The first connecting portion 22 is connected to the lamp 12. The first fixing portion 24 defines a first shaft hole 240. The first fixing member 40 can extend through the first shaft hole 240.

The second connecting member 30 includes a second connecting portion 32 and a second fixing portion 34. The second connecting portion 32 is connected to the stand 14. The second fixing portion 34 defines a second shaft hole 340. The second fixing member 50 can extend through the second shaft hole 340.

The first fixing member 40 includes a first fixing shaft 42, a first head portion 43, and a first magnet 44. The diameter of the first fixing shaft 42 is less than that of the first shaft hole 240 and the second shaft hole 340, thus the first fixing shaft 42 can extend through the first shaft hole 240 and be received in the second shaft hole 340. The first head portion 43 is secured to one end of the first fixing shaft 42. The diameter of the first head portion 43 is greater than that of the first shaft hole 240, thus the first head portion 43 cannot pass through the first shaft hole 240. The first magnet portion 44 is attached to another opposite end of the first fixing shaft 42 using adhesive material. In the embodiment, the south pole of the first magnet 44 is attached to the opposite end of the first fixing shaft 42. In the embodiment, the first magnet 44 is a permanent magnet.

The second fixing member 50 includes a second fixing shaft 52, a second head portion 53, and a second magnet 54. The diameter of the second fixing shaft 52 is slightly less than that of the second shaft hole 340 and the first shaft hole 240, thus the second fixing shaft 42 can pass through the second shaft hole 340 and the first shaft hole. The second fixing shaft 52 defines a first through hole 520 extending along the axis of the second fixing shaft 52. The diameter of the first through hole 520 is larger than that of the first fixing shaft 42, thus the first fixing shaft 42 can be received in the first through hole 520. The second head portion 53 is secured to one end of the second fixing shaft 52. The diameter of the second head portion 53 is greater than that of the second shaft hole 340, thus the second head portion 44 cannot extend or pass through the second shaft hole 340. The second magnet 54 is attached to another opposite end of the second fixing shaft 52 using adhesive material. In the embodiment, the south pole of the second magnet 54 is attached to the opposite end of the second fixing shaft 52. The second magnet 54 defines a second through hole 540. The diameter of the second through hole 540 is equal to that of the first through hole 520, thus the first fixing shaft 42 can pass through the second through hole 540. The second magnet 54 is a permanent magnet.

Figure 4:
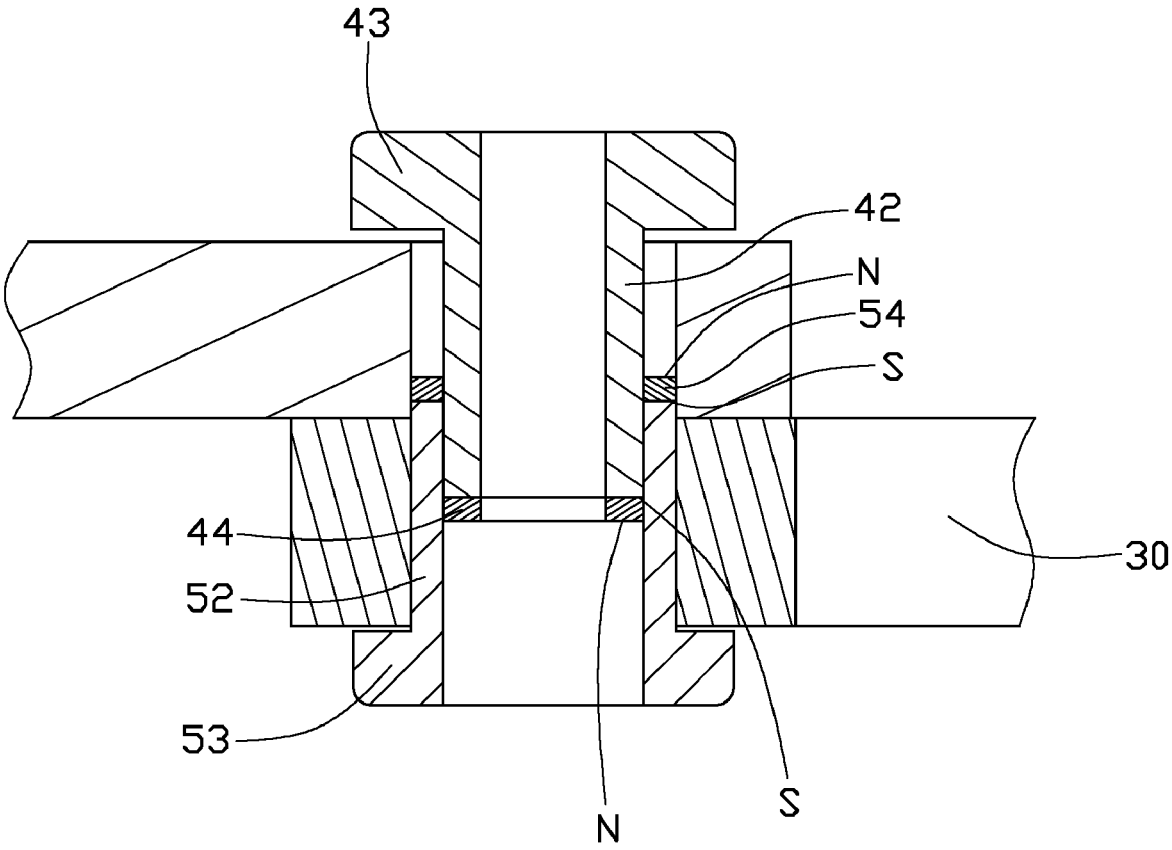
FIG. 4 is a cross-sectional view of the hinge assembly of FIG. 2.

FIG. 4 is employed to illustrate the procedure of assembling the hinge assembly 10. The procedure includes the following steps: inserting the first fixing member 40 into the first connecting member 20; inserting the second fixing member 50 into the second connecting member 30; and inserting the first fixing member 40 into the second fixing member 50. During the process of inserting the first fixing member 40 into the second fixing member 50, the first fixing member 40 is repelled by a first magnetic force between the first magnet 44 and the second magnet 54 to block the insertion of the first fixing member 40 because the first magnet 44 and the second magnet 54 are oriented with their north poles toward each other. After inserting the first fixing member 40 into the second fixing member 30 by overcoming the first magnetic force, the first fixing member 40 is pulled by a second magnetic force to stop the first fixing member from sliding out from the second fixing member 50 because when the first magnet 44 passes together with the first fixing member 40, the south poles of the first magnet 44 and the second magnet 54 repel each other and force the first fixing member 40 to engage with the second fixing member 50. Therefore, the first fixing member 40 engages with the second fixing member 50 under the second magnetic force between the first magnet 44 and the second magnet 54. Therefore engagement of the parts of the present hinge 10 is relatively easy.

Although the present disclosure has been specifically described on the basis of the exemplary embodiment thereof, the disclosure is not to be construed as being limited thereto. Various changes or modifications may be made to the embodiment without departing from the scope and spirit of the disclosure.

What is claimed is:

1. A hinge assembly comprising:

a first connecting member defining a first shaft hole;

a second connecting member defining a second shaft hole;

a first fixing member comprising a first fixing shaft and a first magnet attached to the first fixing shaft, the first fixing shaft extending through the first shaft hole and the first fixing magnet to be received in the second shaft hole; and a second fixing member comprising a second fixing shaft and a second magnet attached to the second fixing shaft, the second fixing shaft extending through the second shaft hole and the second magnet to be received in the first shaft hole, wherein the second fixing shaft defines a first through hole for receiving the first fixing member, and the second magnet defines a second through hole for the first fixing member extending through;

wherein the south pole of the first magnet faces the south pole of the second magnet or the north pole of the first magnet faces the north pole of the second magnet, thereby providing a repelling force to prevent the first fixing member and the second fixing member from detaching from each other.

2. The hinge assembly as described in claim 1, wherein the first magnet and the second magnet are permanent magnets.

3. The hinge assembly as described in claim 1, wherein the first fixing member comprises a first head portion, the diameter of the first fixing shaft is less than that of the first shaft hole, the second shaft hole, and the first through hole, and the diameter of the first head portion is greater than that of the first shaft hole.

4. The hinge assembly as described in claim 3, wherein the second fixing member comprises a second head portion, the diameter of the second fixing shaft is equal to that of the second shaft hole and the first shaft hole, and the diameter of the head portion is greater than that of the second shaft hole.

5. The hinge assembly as described in claim 4, wherein the south pole of the first magnet is attached to one end of the first fixing shaft; and the south pole of the second magnet is attached to one end of the second fixing shaft.

6. The hinge assembly as described in claim 5, wherein the the diameter of the second through hole is equal to that of the first through hole.

* * * * *